US005976321A

United States Patent [19]

Nilsson

[11] Patent Number: 5,976,321

[45] Date of Patent: Nov. 2, 1999

[54] PROCESS FOR MAKING SULFUR ENHANCED UNDIGESTED CELLULOSIC FIBER MATERIAL AND PULP

[75] Inventor: Bengt Nilsson, Skoghall, Sweden

[73] Assignee: Kvaerner Pulping AB, Karstad, Sweden

[21] Appl. No.: 08/960,271

[22] Filed: Oct. 29, 1997

Related U.S. Application Data

[63] Continuation of application No. PCT/SE97/00686, Apr. 24, 1997.

[30] Foreign Application Priority Data

Apr. 30, 1996 [SE] Sweden ..... 9601643

[51] Int. Cl.[6] ..... D21C 3/02

[52] U.S. Cl. ..... 162/82; 162/86; 162/90

[58] Field of Search ..... 162/29, 38, 86, 162/30.1, 35, 36, 82, 90, 19

[56] References Cited

U.S. PATENT DOCUMENTS 3,841,962 10/1974 Procter et al. ..... 162/30
4,113,553 9/1978 Samuelson ..... 162/34

FOREIGN PATENT DOCUMENTS

WO 93/12288 6/1993 WIPO .

OTHER PUBLICATIONS

Hershmil, "A New Process for Pulping with High Initial Hydrosulfide Concentration", vol. 80, No. 3, TAPPI Journal, pp. 115–121 (1996).

*Primary Examiner*—Dean T. Nguyen
*Attorney, Agent, or Firm*—Jeffrey S. Melcher; Farkas & Manelli, PLLC

[57] ABSTRACT

Provided is a process for making pulp having the steps of:

contacting an undigested cellulosic fiber material with a pretreatment liquid formulated from a mixture comprising alkali metal bicarbonate and alkali metal hydrogen sulfide as reaction components which are dissolved or disbursed in an aqueous liquid, under conditions that:

(1) the reaction components react to form $H_2S$, $CO^2$ and alkali metal carbonate in situ;

(2) $HS^-$ ions are formed by disassociation of $H_2S$ and/or by disassociation of alkali metal hydrogen sulfide; and (3) at least a portion of the $H_2S$ and/or $HS^-$ ions is absorbed or diffused into the undigested cellulosicfiber material to enhance the sulfur content of the undigested cellulosic fiber material, to form a sulfur enhanced, undigested cellulosic fiber material, wherein the pretreatment liquid is substantially free of alkali metal hydroxide; and digesting the sulfur enhanced, undigested cellulosic fiber material in a digester to form a pulp.

14 Claims, 3 Drawing Sheets

PROCESS FOR MAKING SULFUR ENHANCED UNDIGESTED CELLULOSIC FIBER MATERIAL AND PULP

This application is a continuation-in-part of PCT/SE97/00686 filed on Apr. 24, 1997, and claims priority to Swedish patent application SE 9601643-1 filed on Apr. 30, 1996. The complete disclosures of these applications are incorporated herein by reference.

FIELD OF THE INVENTION

The present invention relates to processes for producing undigested cellulosic fiber material and pulp. The present invention also relates to an integrated pulp production process.

BACKGROUND OF THE INVENTION

White liquor consists of a water solution of the active digestion chemicals sodium hydroxide ("NaOH") and sodium hydrogen sulfide ("NaHS"), which are included in the term "alkali". The alkali in the white liquor is consumed during the digestion of cellulosic fiber material by reacting with both lignin and carbohydrates, such as cellulose and hemicellulose. The higher the concentration of sodium hydrogen sulfide compared to the concentration of sodium hydroxide, the higher the sulfidity. The sulfidity represents the weight percentage of alkaline sulfur containing compounds present based on the total weight of alkaline compounds present. The sulfidity of the white liquor is dependent upon several different factors present in a sulfate factory of the pulp plant, and a general aim is to increase the sulfidity in the white liquor. The sulfidity can be increased by various measures, such as by closing the chemical system in the factory and recovering sulfur from various gas discharges. In this way the sulfidity level can be increased from an initial level of 30% to a level of about 45%.

The sulfidity is a significant process variable and therefore research is directed to further increasing the sulfidity. An increase in sulfur or sulfur containing compounds that are capable of producing hydrogen sulfide ions ("$HS^-$") in the digesting liquor results in a quicker digestion process, higher pulp yield and better pulp quality. This is because $HS^-$ ions are capable of reacting with lignin through different reaction paths than hydroxyl ions so that the delignification occurs at higher speed and thus chemical attack of the carbohydrates is reduced.

Published Swedish patent application No. SE-9202996-5 discloses adding recovered hydrogen sulfide to the impregnation of wood chips prior to delignification. However, such an addition is difficult to perform because hydrogen sulfide is an exceptionally toxic gas and it must be added to a pressurized chip bed. It is also difficult to dispose of or reuse excess hydrogen sulfide after impregnation.

U.S. Pat. No. 3,841,962 describes a method of pretreating chips with an alkali enhanced liquor. The alkali enhanced liquid is produced by crystallizing and separating $Na_2CO_3$ out of a green liquor in order to obtain an increased concentration of alkali, in particular NaHS and NaOH. The alkali enhanced liquor is supplied to the pretreatment tank, and $CO_2$ is added to effect carbonation and the formation of $NaHCO_3$ and $H_2S$ in situ. After the pretreatment, a liquid is withdrawn which contains remnants of $NaHCO_3$ and dissolved $H_2S$ and $CO_2$. This method has the problem that it is difficult to dispose of this liquid. Furthermore, the pretreatment liquid must be made from freshly produced green liquor which requires treatment to separate the $Na_2CO_3$ followed by addition of $CO_2$. Moreover, this method limits the desired excess of $H_2S$ at the pretreatment stage.

A limiting factor for increasing the sulfidity in white liquor is mainly the use of a soda boiler for recovering digestion chemicals and the necessary causticizing of the green liquor produced from melt from the soda boiler.

Published Swedish patent application No. SE-B-468 600 discloses a method for obtaining white liquor of high sulfidity directly from the gasification reactor, without the need for causticizing. According to this procedure, hydrogen sulfide is recovered from gas leaving a reactor for the thermal decomposition of black liquor and the hydrogen sulfide is returned to the reactor. Such a high partial pressure of hydrogen sulfide is thus established in the gasification stage that the equilibrium reaction:

$$Na_2CO_3+H_2S \leftrightarrows Na_2S+CO_2+H_2O$$

is displaced so far to the right that the formation of $Na_2CO_3$ is suppressed. The $Na_2S$ formed is easily dissociated in water to NaOH and NaHS. The recovery of hydrogen sulfide from the gas step is accomplished by passing the gas through a gas scrubber containing an external absorption chemical, such as N-methyl pyrolidone or methyl di-ethyl amine, for selective and regenerative absorption of $H_2S$. This process has two significant drawbacks, (1) the need for external chemicals and (2) the requirement of a regeneration step to strip the hydrogen sulfide from the absorption chemical.

There is a need for a process of making pulp which increases the sulfidity in the digester and avoids the above problems associated with conventional pulp production processes.

SUMMARY OF THE INVENTION

An objective of the present invention is to provide an improved process for increasing the sulfidity in the digester while avoiding expensive causticizing steps.

Another objective of the present invention is to provide an improved method for pretreating undigested cellulosic fiber material with compounds containing sulfur to increase the sulfur content in the undigested cellulosic fiber material and provide a sulfur enhanced, undigested cellulosic fiber material. The sulfur enhanced, undigested cellulosic fiber material has the advantage of increasing the sulfidity in the digester.

Another objective of the invention is to provide a process for operating a pulp production plant, including digestion of cellulosic fiber material under increased sulfidity, which enables total integration of the various process steps so that chemicals can be recovered and prepared to form active solutions for the various treatment steps without having to use conventional causticizing and calcination in order to strip carbon dioxide.

The above objectives and other objectives can be achieved by the following processes for pretreating undigested cellulosic fiber material.

The invention provides a novel process for making a sulfur enhanced, undigested cellulosic fiber material comprising the step of:

contacting an undigested cellulosic fiber material with a pretreatment liquid formulated from a mixture comprising alkali metal bicarbonate and alkali metal hydrogen sulfide as reaction components which are dissolved or disbursed in an aqueous liquid, under conditions that:

(1) the reaction components react to form $H_2S$, $CO_2$ and alkali metal carbonate in situ;

(2) $HS^-$ ions are formed by disassociation of $H_2S$ and/or by disassociation of alkali metal hydrogen sulfide; and (3) at least a portion of the $H_2S$ and/or $HS^-$ ions is absorbed or diffused into the undigested cellulosic fiber material to enhance the sulfur content of the undigested cellulosic fiber material, to form a sulfur enhanced, undigested cellulosic fiber material. The pretreatment liquid is substantially free of alkali metal hydroxide.

The invention further provides a novel process for making a sulfur enhanced, undigested cellulosic fiber material comprising the step of:

contacting an undigested cellulosic fiber material with a pretreatment liquid comprising a high sulfidity spent liquor containing hydrogen sulfide ions and/or at least one compound capable of generating hydrogen sulfide ions, under conditions whereby hydrogen sulfide ions are absorbed or disbursed in the cellulosic fiber material to form a sulfur enhanced, undigested cellulosic fiber material.

The present invention also relates to a novel process for making pulp comprising the steps of:

contacting an undigested cellulosic fiber material with a pretreatment liquid formulated from a mixture comprising alkali metal bicarbonate and alkali metal hydrogen sulfide as reaction components which are dissolved or disbursed in an aqueous liquid, under conditions that:

(1) the reaction components react to form $H_2S$, $CO_2$ and alkali metal carbonate in situ;

(2) $HS^-$ ions are formed by disassociation of $H_2S$ and/or by disassociation of alkali metal hydrogen sulfide; and (3) at least a portion of the $H_2S$ and/or $HS^-$ ions is absorbed or diffused into the undigested cellulosic fiber material to enhance the sulfur content of the undigested cellulosic fiber material, to form a sulfur enhanced, undigested cellulosic fiber material, wherein the pretreatment liquid is substantially free of alkali metal hydroxide; and digesting the sulfur enhanced, undigested cellulosic fiber material in a digester to form a pulp.

The invention further provides a novel process for making pulp comprising the step of:

contacting an undigested cellulosic fiber material with a pretreatment liquid comprising a high sulfidity spent liquor containing hydrogen sulfide ions and/or at least one compound capable of generating hydrogen sulfide ions, under conditions whereby hydrogen sulfide ions are absorbed or disbursed in the cellulosic fiber material to form a sulfur enhanced, undigested cellulosic fiber material; and digesting the sulfur enhanced, undigested cellulosic fiber material in a digester to form a pulp.

The invention also provides a novel method for operating a pulp production plant comprising at least two gasification reactors. The gasification reactors are utilized to form the cooking liquors for use in the above methods.

DETAILED DESCRIPTION OF PREFERRED EMBODIMENTS

Figure 1:
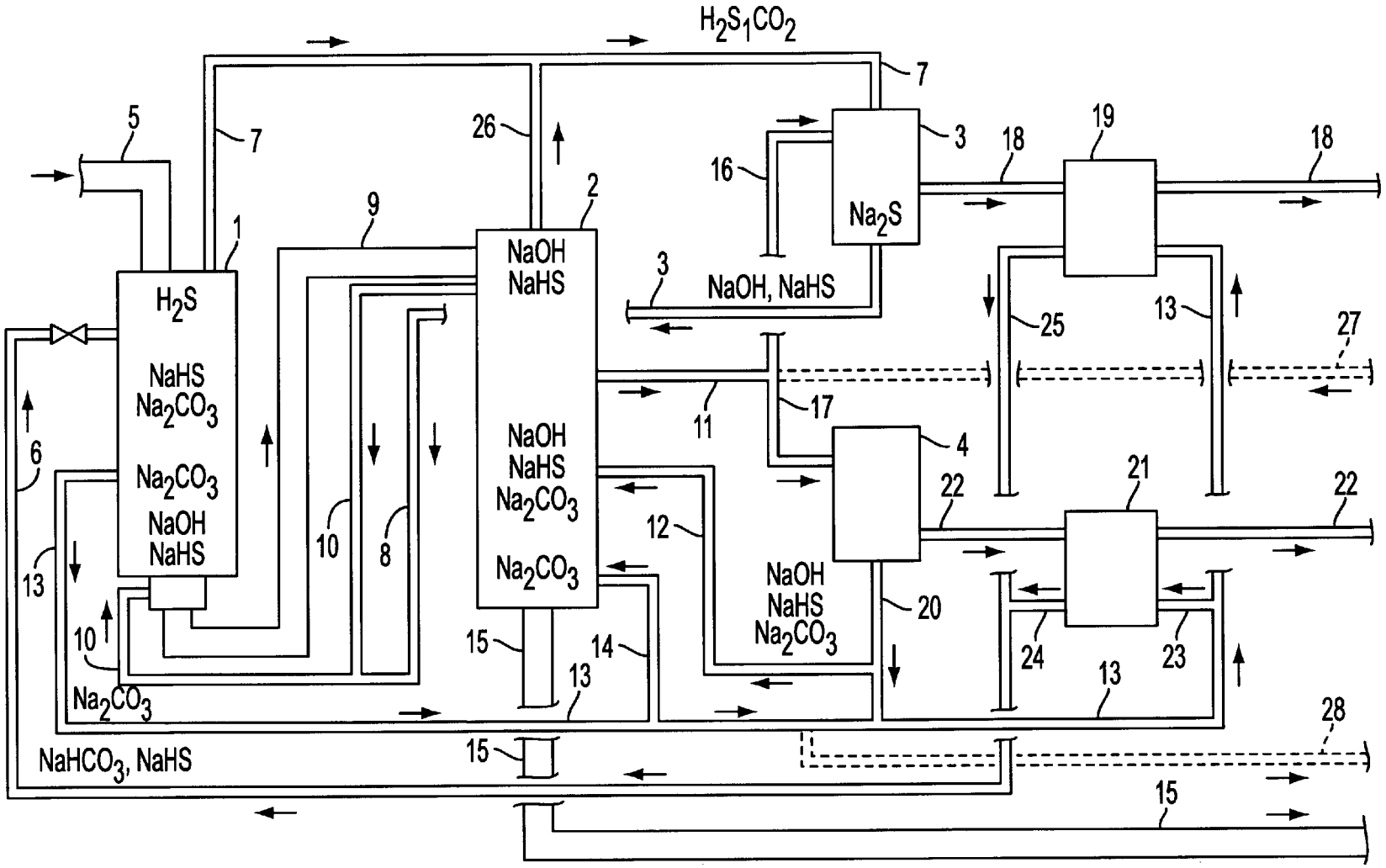
FIG. 1 illustrates a schematic diagram of a first embodiment according to the present invention.

The novel process for producing pulp from cellulosic fiber material includes the step of operating the digester under increased sulfidity, whereby an improved digested pulp is obtained. The sulfidity in the digester can be increased by the following methods:

(A) enhancing the sulfur content of the cellulosic fiber material entering the digester; and (B) enhancing the sulfur content of the cooking liquids being supplied to the digester.

The present invention can be practiced by enhancing the sulfur content of the undigested cellulosic fiber material alone. However, the sulfidity in the digester is preferably enhanced by enhancing the sulfur content of the undigested cellulosic fiber material in combination with enhancing the sulfur content of the cooking liquids supplied to the digester. The term "undigested cellulosic fiber material" is understood herein to mean cellulosic fiber material which has not been completely digested, and includes cellulosic fiber material which has been subjected to partial digestion. Digested cellulosic fiber material is referred to as "pulp".

The sulfur content of the cellulosic fiber material, in particular the $H_2S$ and $HS^-$ content of the cellulosic fiber material, can be enhanced according to the present invention by utilizing an improved pretreatment stage which is upstream of the digesting stage.

During the improved pretreatment stage, the cellulosic fiber material is contacted with a pretreatment liquid containing sulfur compounds under conditions such that the sulfur compounds are absorbed or dispersed into the cellulosic fiber material to provide a sulfur enhanced cellulosic fiber material. The sulfur enhanced cellulosic fiber material is then digested in the digester to form pulp.

Preferably, the sulfur compounds and reaction conditions in the pretreatment stage are selected to provide a cellulosic fiber material having an enhanced concentration of hydrogen sulfide ions, $HS^-$. It has been found that an increased level of sulfur provides a digested cellulosic fiber material having a lower Kappa number. It is believed that the sulfur restricts the reaction between an alkali metal hydroxide and carbon dioxide to form an alkali metal carbonate, thus ensuring the presence of active alkali during digestion of the cellulosic fiber material.

The improved pretreatment stage according to the present invention will now be described with reference to two embodiments.

Pretreatment According to First Embodiment

In a first embodiment, the pretreatment stage includes the step of contacting the undigested cellulosic fiber material with a pretreatment liquid comprising at least one alkali metal bicarbonate and at least one alkali metal hydrogen sulfide as reaction components in a pretreatment reaction vessel under conditions such that the following combination of reactions occur:

(1) the reaction components react to form $H_2S$, $CO_2$ and alkali metal carbonate in situ;

(2) $HS^-$ ions are formed by disassociation of $H_2S$ and/or disassociation of the alkali metal hydrogen sulfide; and (3) at least a portion of the $H_2S$ and/or $HS^-$ ions is absorbed or diffused into the undigested cellulosic fiber material to enhance the sulfur content of the undigested cellulosic fiber material.

The alkali metal is preferably sodium or potassium.

The reactions conditions required to provide the combination of reactions (1) through (3) will vary depending upon primarily the following factors, the pulping equipment utilized, the type of cellulosic fiber material, and the composition of the liquors present. Based on the disclosure provide herein, one skilled in the art will easily be able to determine reaction conditions which provide the combination of reactions (1) through (3) without undue experimentation.

For example, it has been found that suitable reaction conditions can be achieved by adjusting the pressure and temperature of the undigested cellulosic fiber material and the pretreatment liquid in the pretreatment reaction vessel. A suitable range of operating pressures in the pretreatment reaction vessel has been found to be from about 0.5 to about 8 bar, preferably about 1 to about 5 bar. A suitable range of operating temperatures in the pretreatment reaction vessel has been found to be from about 70 to about 170° C., preferably about 90 to about 120° C. A suitable range of pH has been found to be from about 4 to about 8, preferably from about 5 to about 7. For example, the pretreatment liquid can be held under a pressure high enough to prevent carbon dioxide from escaping, such as at least about 25 bar, such that when the pretreatment liquid enters the vessel, carbon dioxide gas escapes from the pretreatment liquid in the reduced pressure of the vessel. As the carbon dioxide escapes from pretreatment liquid, the reaction between the alkali metal bicarbonate and the alkali metal hydrogen sulphide proceeds to produce more carbon dioxide, along with the desired $H_2S$ and HS_ ions.

The pretreatment reaction should be conducted for time period sufficient to react substantially all of the alkali metal bicarbonate and alkali metal hydrogen sulfide. For example, on a commercial scale pulp mill, the complete reaction of alkali metal bicarbonate and alkali metal hydrogen sulfide usually requires at least about 10 minutes, more preferably at least about 20 minutes.

The process conditions, such as pressure and temperature, can be varied or kept constant as the pulp travels through the pretreatment reaction vessel, as desired. For example, if a vertical pretreatment vessel is utilized, the pressure can increase as the undigested cellulosic fiber material travels towards the bottom of the pretreatment vessel.

The pretreatment liquid should be added to the cellulosic fiber material in an amount sufficient to provide the desired level of sulfur in the cellulosic fiber material. Preferably, the pretreatment liquid is added in an amount sufficient to provide an increase in the sulfur content of the undigested cellulosic fiber material that provides the desired Kappa number in the digested cellulosic fiber material. The kappa number is a well known term in the pulping art field. In general, the lower the desired kappa number of the digested cellulosic fiber material, the greater the quantity of effective alkali that should be added to the undigested cellulosic fiber material. Conversely, the higher the desired kappa number of the digested cellulosic fiber material, the less the quantity of effective alkali that should be added to the undigested cellulosic fiber material. A high content of sulfur generally provides a high level of effective alkali by driving the following equilibrium reaction to the right:

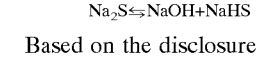

$$Na_2S \leftrightarrows NaOH + NaHS$$

Based on the disclosure provided herein, one skilled in the art will easily be able to determine the amount of pretreatment liquid necessary to provide the desired Kappa number for the digested cellulosic fiber material.

According to a particularly preferred embodiment, the quantity of pretreatment liquid supplied to the undigested cellulosic fiber material, calculated with regard to alkali metal bicarbonate and alkali metal hydrogen sulfide, is such that, under the prevailing operating conditions, a controlled large surplus of $H_2S$ is formed during the pretreatment step.

The $CO_2$ produced can be easily withdrawn from the pretreatment reaction vessel. Thus, expensive and time consuming processes, such as causticizing and calcination to strip carbon dioxide, can be avoided.

Production of Pretreatment Liquid for First Embodiment

The pretreatment liquid can be formed by dissolving or dispersing an alkali metal bicarbonate and an alkali metal hydrogen sulphide in an aqueous liquid. Alternatively, the alkali metal bicarbonate and alkali metal hydrogen sulphide can be generated in the aqueous liquid. For example, the pretreatment liquid can be formed from green liquor which has been allowed to selectively absorb $H_2S$ and, as co-absorption to a lesser extent, $CO_2$, to obtain $NaHCO_3$ and NaHS in accordance with the following equilibrium reactions:

$NaHCO_3$ and NaHS:

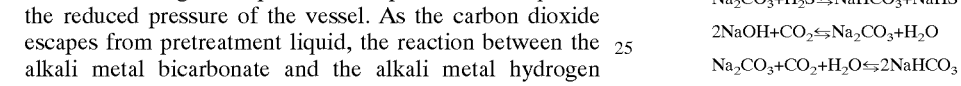

$$NaOH + H_2S \leftrightarrows NaHS + H_2O$$

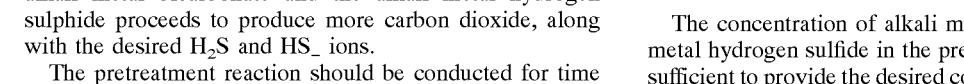

$$Na_2CO_3 + H_2S \leftrightarrows NaHCO_3 + NaHS$$

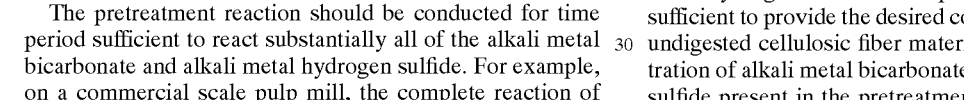

$$2NaOH + CO_2 \leftrightarrows Na_2CO_3 + H_2O$$

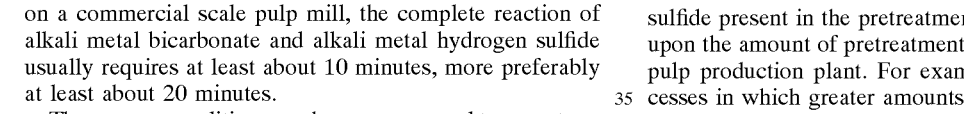

$$Na_2CO_3 + CO_2 + H_2O \leftrightarrows 2NaHCO_3$$

The concentration of alkali metal bicarbonate and alkali metal hydrogen sulfide in the pretreatment liquid should be sufficient to provide the desired concentration of sulfur in the undigested cellulosic fiber material. In general, the concentration of alkali metal bicarbonate and alkali metal hydrogen sulfide present in the pretreatment liquid will be dependent upon the amount of pretreatment liquid to be utilized in the pulp production plant. For example, pulp production processes in which greater amounts of pretreatment liquor are to be contacted with the undigested cellulosic fiber material, lower concentrations of alkali metal bicarbonate and alkali metal hydrogen sulfide can be utilized. Suitable concentrations have been found to be from dilute solutions having about 0.1 mole/liter for each of alkali metal bicarbonate and alkali metal hydrogen sulfide, up to the solubility limit of the selected alkali metal bicarbonate and the selected alkali metal hydrogen sulfide at the process conditions the pretreatment liquid is subject to prior to being introduced to the pulp.

The relative amount of alkali metal bicarbonate and alkali metal hydrogen sulfide can be selected as desired to provide the desired amount of $H_2S$ and $HS^-$. In general, it is preferable to utilize the alkali metal bicarbonate and alkali metal hydrogen sulfide to provide an excess of $H_2S$. An excess of $H_2S$ ensures that the concentration of sulfur in the undigested cellulosic material is sufficient and provide a supply of beneficial $H_2S$ that can be used elsewhere in the pulp production plant, such as during combustion of spent liquor in a gasification reactor or to enhance the sulfidity of a liquor.

If sodium bicarbonate and sodium hydrogen sulfide are utilized as the reaction components in the pretreatment liquid, suitable amounts of reaction components have been found to be from at least about 60%, preferably at least about 80%, and more preferably at least about 90% by weight, based on the total weight of compounds present in the aqueous liquid and excluding the weight of the aqueous liquid. The remainder of the chemical compounds usually comprise sodium carbonate.

The presence of alkali metal hydroxide in the pretreatment liquid can cause an undesirable reaction with the alkali metal bicarbonate to form an alkali metal carbonate and water. Therefore, the pretreatment liquid containing alkali metal bicarbonate preferably is substantially free of alkali metal hydroxide.

During the pretreatment stage, a spent pretreatment liquor is formed containing substantially alkali metal carbonate, which can easily be separated from the undigested cellulosic fiber material, if desired. The spent pretreatment liquor can be regenerated by contacting the spent pretreatment liquor with $H_2S$ under reaction conditions such that the alkali metal carbonate reacts with the $H_2S$ to form an alkali metal bicarbonate and alkali metal hydrogen sulfide according to the following equilibrium reaction:

$$Na_2CO_3+H_2S \leftrightharpoons NaHCO_3+NaHS$$

Preferably, at least a part of the spent pretreatment liquid containing alkali metal carbonate is transferred to a recovery step to be brought into contact with combustion gas containing $H_2S$ formed from the gasification of a spent liquor, to regenerate the pretreatment liquid. For example, the combustion gas containing $H_2S$ gas can be formed using a gasification reactor as described U.S. Pat. No. 4,808,264, (Kignell), the complete disclosure of which is incorporated herein by reference.

The pretreatment step according to the present invention is preferably conducted in combination with supplying sulfur enhanced cooking liquors to the digester. The sulfur content of the cooking liquid entering the digester can be enhanced by adding sulfur compounds to the cooking liquor. For example, sulfur enhanced white liquor to be used as a cooking liquor can be formed as follows. White liquor having a high sulfidity can generally be manufactured for the digestion stage in the process according to the invention by allowing conventional white liquor to absorb $H_2S$ gas or by adding to the white liquor elemental sulfur for forming polysulfide. The $H_2S$ gas is preferably supplied from a combustion gas formed in a gasification reactor from a spent liquor. The high sulfidity white liquor usually has a sulfidity which is greater than the usual sulfidity of white liquor produced in a conventional pulp plant. For example, the high sulfidity white liquor according to the present invention has a sulfidity of at least about 40%, preferably greater than 45%, more preferably at least about 50%, and most preferably at least about 70%.

The high sulfidity white liquor can also be formed directly by quenching the melt from a gasification reactor in which enhanced quantities of $H_2S$ or other sulfur sources have been supplied to the gasification reactor. While the quench liquid formed is usually referred to a green liquor, one skilled in the art can easily adjust the reactor conditions such that the green liquor has a chemical make-up similar to white liquor by directly forming an alkali metal hydroxide without causticizing. In that instance, it will be understood by one skilled in the art that white liquor is being produced directly by quenching the melt from the gasification reactor. Thus, based on the disclosure provided herein, one skilled in the art will now also be able to adjust the gasification reactor conditions to enhance the sulfidity of the directly produced white liquor.

Figure 3B:
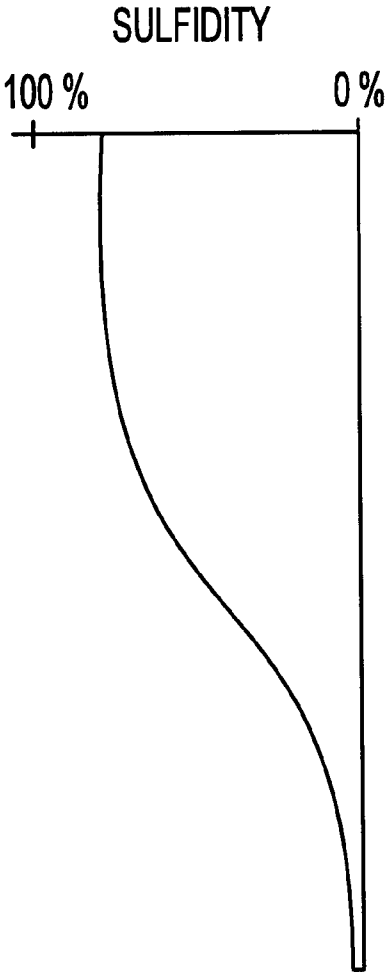
FIG. 3 illustrates a three zone concurrent and countercurrent digester being operated by a method according to the present invention.
Figure 3A:
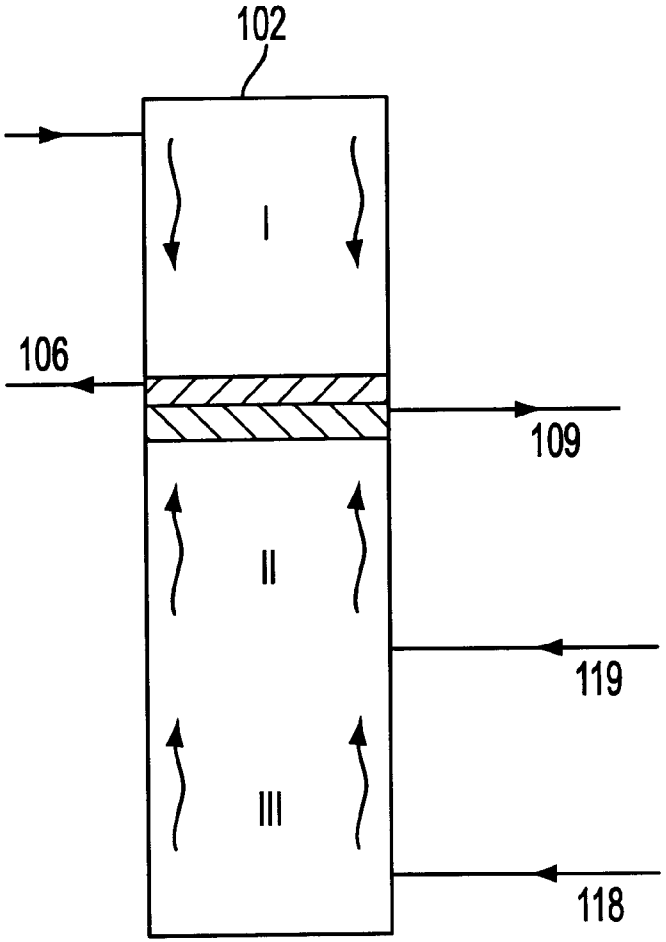

The digesting stage having an increased sulfidity according to the present invention preferably utilizes a three zone concurrent and counter-current, pressurized digester, such as a Kvaerner continuous digester, as shown in FIG. 3. FIG. 3 illustrates a preferred method of operating a three zone pressurized digester according to the present invention. As shown in FIG. 3, green liquor having a low sulfidity can be added to a counter-current digestion zone shown at III. Alternatively, white liquor having a low sulfidity can be added to the counter-current digestion zone shown at III. Preferably, a low sulfidity green liquor, produced by quenching a melt from a gasification reactor, is used in the counter-current digestion zone shown III.

The invention offers an advantageous method of directly producing a low-sulfidity green liquor, which is suitable for use in a digesting process. An example of the production of such low-sulfidity green liquor will be described herein below with reference to FIG. 1.

The present invention includes a substantially closed pulp plant which includes the process steps of recovering chemicals and energy from pretreatment spent liquor and other spent liquors, such as digesting spent liquors, and the formation of usable gasses from the spent liquors, for the production of pretreatment liquid and digester cooking liquids.

Preferably, at least a part of the pretreatment spent liquor containing alkali metal carbonate is transferred to a recovery step to be brought into contact with a combustion gas containing $H_2S$ formed during the gasification of spent liquor in a gasification reactor, to regenerate the pretreatment liquid. The regenerated pretreatment liquid can be used in the pretreatment of the undigested cellulosic fiber material.

A surplus of $H_2S$ gas is preferably formed in the pretreatment step, which can be conducted to a gasification reactor to increase the sulfur content of a liquor produced during quenching of the melt from the gasification reactor such that the produced green liquor has a chemical make-up similar to white liquor produced by conventional causticizing methods, and if desired, also having a high sulfidity. In this manner, high sulfidity white liquor can be produced directly from the gasification reactor without the need for an expensive causticizing step. Furthermore, the sulfidity of the white liquor can be easily adjusted to the desired level by increasing or decreasing the concentration of $H_2S$ and/or other sulfur compounds supplied to the gasification reactor. A portion of the high sulfidity white liquor is preferably used as a cooking liquor in a first zone of the high pressure digester, as shown at I in FIG. 3.

A part of the spent pretreatment liquor withdrawn from the undigested cellulosic fiber material is preferably gasified in a gasification reactor to produce the low sulfidity green liquor. As described herein above, a part of this low sulfidity green liquor is preferably supplied to a third section of a pressurized digester, shown at III in FIG. 3.

A mid level sulfidity green liquor or white liquor, each having a sulfidity level between the high sulfidity white liquor and the low sulfidity green liquor, can be supplied to the counter-current zone of the digester shown at II. In this manner, the sulfidity can be made to vary throughout the digester, as shown in FIG. 3. As shown in FIG. 3, the sulfidity is higher towards zone I and lower towards zone III. The following Table 1 shows an example of the sulfidity for the liquors supplied to each of the three zones in the digester. In the Table 1, the FIG. "0" indicates a very low sulfidity level, but not necessarily zero.

TABLE 1

| Component | I | II | III |
|---|---|---|---|
| NaHS (moles/liter) | 2 | 0.47 | 0 |
| NaOH (moles/liter) | 2 | 1.09 | 0 |

TABLE 1-continued

| Component | I | II | III |
|---|---|---|---|
| $Na_2CO_3$ (moles/liter) | 0 | 1.21 | 2 |
| NaHS (grams/liter) | 80 | 19 | 0 |
| NaOH (grams/liter) | 80 | 44 | 0 |
| $Na_2CO_3$ (grams/liter) | 0 | 98 | 150 |
| Sulfidity (%) | 50 | 30 | 0 |

The mid level sulfidity green liquor can be produced by adjusting the level of sulfur present in a gasification reactor such that a green liquor is produced having the desired level of sulfidity. Alternatively, the mid level sulfidity green liquor can be formed by contacting the low sulfidity green liquor with a sulfur compound, such as $H_2S$, $HS^-$, and/or polysulfide. The $H_2S$ may be obtained from the gas being discharged from the pretreatment vessel and/or from the combustion gas from a gasification reactor. A scrubber containing absorption chemicals can be used to separate the desired $H_2S$ from the gas stream. The combustion gas is preferably from the gasification of spent liquor for the production of the green liquor having high sulfidity which is used as a white liquor having a high sulfidity. The polysulfide can be produced from liquid sulfur and $H_2S$ which is absorbed therein, or from liquid sulfur and $Na_2S$ originating from the gasification of spent liquor for the production of white liquor of high sulfidity. The liquid sulfur can be produced in a Claus apparatus in which $H_2S$ is converted to elementary sulfur, and to which gas containing $H_2S$ is supplied from the pretreatment vessel and/orfrom a combustion gas.

A part of the low sulfidity green liquor produced in the gasification reactor is preferably brought into contact with a gas containing $H_2S$, such as from the pretreatment vessel or combustion gas formed from gasification of spent liquor, to produce a pretreatment liquid.

Conventional green liquors which typically have an NaHS content of about 30 g/1, calculated as NaOH, whereas the low sulfidity green liquor produced through said gasification at increased pressure, with the resultant displacement in reaction equilibrium, has an NaHS content of about 9 to about 15 g/1. The low sulfidity green liquor can be produced by quenching a melt from a gasification reactor.

The method according to the first embodiment is capable of providing the necessary pretreatment and cooking liquids to be produced without the need of a soda boiler or of equipment for causticizing and thus avoids the complicated calcium cycle. Furthermore, the carbon dioxide formed in the process steps, including the recovery steps, can be easily removed from the system without requiring the use of a calcium treatment, in particular, by separation in the combustion gas. Although it is preferred not to make use of conventional soda boiler and causticizing systems, it lies within the scope of the invention to use such a system for recovering chemicals to be added to the digester.

According to a particularly preferred embodiment, the quantity of pretreatment liquid supplied for pretreating the cellulosic fiber material, calculated with regard to alkali metal bicarbonate and alkali metal hydrogen sulfide, is such that, under the prevailing operating conditions, a controlled large surplus of $H_2S$ is formed during the pretreatment. The $H_2S$ can be conducted to a gasification reactor to be present in the gasification of spent liquor with a controlled, increased partial pressure of sulfur.

The pretreatment liquid according to the invention can be manufactured from recirculated liquors containing substantially $Na_2CO_3$ and an insignificant quantity of dissolved substances from the cellulosic fiber material source, to provide a closed system. The sulfidity of green liquor having low NaHS content or other liquor to be used to form the pretreatment liquid, can be increased as follows. Preferably, the absorption of $H_2S$, which may take place in several steps with the relevant liquids mixed or one by one, is designed for selective $H_2S$ absorption and the least possible co-absorption of $CO_2$. The contact apparatus for gas-liquid is preferably designed with multi-step contact in counter-flow in series in order to achieve a predetermined ratio between $H_2S$ absorption and $CO_2$ absorption so that the pH value of the pretreatment step can be controlled. For this purpose, atomized liquid can be used having small drops which offer a large surface area and good mixing with the gas. It has been found that best selectivity of $H_2S$ (co-absorption of $CO_2$) can be achieved through extremely brief contact time, preferably about 0.1 to about 0.01 second.

In a preferred embodiment according to the first embodiment, gas containing $H_2S$ is brought into contact with spent liquor so that $H_2S$ is absorbed selectively by the spent liquor in order to obtain a spent liquor enriched with sulfur. Such a spent liquor may comprise, spent pretreatment liquid, black liquor, partially evaporated spent liquor from the digestion step and/or spent liquor from the bleaching department, which is preferably alkaline. The gas containing $H_2S$ suitably comes from the pretreatment vessel. However, the gas may also be formed from combustion gas from the gasification of spent liquor which results in white liquor having high sulfidity and/or gasification of spent liquor which results in green liquor having a low sulfidity. It is suitable for the sulfur-enriched, partially evaporated spent liquor to be fully evaporated in order to obtain black liquor.

The black liquor enriched with sulfur may advantageously be gasified to directly produce white liquor having high sulfidity and/or green liquor having a low sulfidity. It is also advantageous to treat the undigested cellulosic fiber material with the sulfur enriched spent liquor before or in conjunction with the pretreating step according to the first embodiment, in which case spent liquor from this treatment is withdrawn from the undigested cellulosic fiber material and gasified directly or after evaporation. A preferred method of pretreating the undigested cellulosic fiber material with a sulfur enriched spent liquor will be described in the second embodiment.

The first embodiment of the invention will now be described in detail with reference to FIG. 1. FIG. 1 schematically illustrates a flow chart of a process line for the manufacture of paper pulp according to the first embodiment of the present invention. In particular, FIG. 1 illustrates a flow chart of a process line for the manufacture of paper pulp from undigested cellulosic fiber material, from wood, through total integration of the pretreatment, impregnation, digestion and recovery process steps. If desired, bleaching may also be included as a process step in this total integration, in which case the spent liquor evaporated at the recovery step may comprise spent liquor from the bleaching department which, for example, can be supplied via a conduit 27. In the latter case, Na2CO3 withdrawn from the pretreatment vessel may comprise the raw product for the bleaching department's requirement of NaOH after separate causticizing, to which the $Na_2CO_3$ can be transferred via a conduit 28. Pretreatment is performed in a pretreatment vessel 1 and impregnation and digestion in a concurrent and counter-current digester 2. Gasification of black liquor, which has been evaporated, precipitated, or in some other way been reduced in water content (not shown), is performed in a first gasification reactor 3 and a second gasification reactor 4.

Undigested cellulosic fiber material, wood chips, are fed by an arrangement 5 to the top of the pretreatment vessel. The temperature in the pretreatment vessel is from about 70 to about 170° C., preferably from about 90 to about 120° C. A pretreatment liquid is introduced via a pipe 6 into the upper part of the pretreatment vessel 1. The pretreatment liquid contains $NaHCO_3$ and NaHS as the primary reaction components, and is substantially free of hydroxyl ions. The pretreatment liquid in the pipe 6 has a relatively high pressure, typically about 25 bar. The pressure in the pretreatment vessel 1 is usually within the range of from about 0.5 to about 8 bar, preferably from about 1 to about 5 bar. When the pretreatment liquid enters the pretreatment vessel, it expands and the development of gases and formation of carbonate commence through the following reactions:

$$NaHCO_3+NaHS \leftrightarrows H_2S+Na_2CO_3$$

$$2NaHCO_3 \leftrightarrows CO_2+Na_2CO_3+H_2O$$

The formation of $H_2S$ and $CO_2$ gas provide the benefit of an approximately neutral or weakly acid pH value in the cellulosic fiber material suspension. The pH value generally lies within the range of from about 4 to about 8, preferably from about 5 to about 7.

The reactions continue down through the pretreatment vessel 1 until all or substantially all of the sodium hydrogen sulfide and sodium bicarbonate have been converted to $Na_2CO_3$, $CO_2$ and excess $H_2S$ and/or $HS^-$ ion, which rise in the tank and are fed out through a pipe 7. $H_2S$ and $HS^-$ are thus formed in situ, not merely outside but also in a favorable manner inside the cellulosic fiber material. Part of the $H_2S$ and $HS^-$ will penetrate into the cellulosic fiber material through absorption and/or diffusion. In this pretreatment, thus, the $HS^-$ ion is given priority over the $OH^-$ ion, which is particularly valuable since the $OH^-$ ions have a much greater tendency to attack carbohydrates rather than lignin. Since $OH^-$ ions are restrained during the pretreatment and $HS^-$ is selective towards lignin, a valuable increase in quality and yield of digested pulp is obtained. The duration of the pretreatment is usually at least about 10 minutes, preferably at least about 20 minutes.

The pH of the cellulosic fiber material during the pretreatment can be buffered by the sodium carbonate formed which dissociates at the high temperatures present in the pretreatment vessel, with a displaced equilibrium towards $OH^-$ ions in accordance with the following reactions:

$$Na_2CO_3 \rightarrow 2Na^+ + CO_3^{2-}$$

$$CO_3^{2-}+H_2O \leftrightarrows HCO_3^- + OH^-$$

The spent pretreatment liquid containing alkali metal carbonate can be withdrawn at the lower part of the pretreatment vessel 1 and fed through a conduit 13 to the zone III of the digester, shown at 14, orto one or more of the gas/liquid contactors shown at 19 and 21, for regenerating the pretreatment liquid. The cellulosic fiber material treated in this way are transferred via a conduit 9 from the bottom of the pretreatment vessel 1 to the top of the digester 2, zone I of the digester, with the aid of liquid withdrawn from the upper part of the digester 2 and allowed to circulate through a conduit 10 to the bottom part of the pretreatment vessel 1. A conduit 8 is connected to the conduit 10 for the supply of a high sulfidity white liquor to the zone I of the digester. Impregnation of the cellulosic fiber material with digesting liquid takes place in the upper part (zone 1) of digester 2, after which follows a concurrent digestion zone II with digestion temperature, typically about 165° C. The liquid/cellulosic fiber material ratio can be adjusted as necessary for the pulping equipment used, and usually is within conventional values, such as about 4:1. Withdrawal of gas, such as carbon dioxide, can be carried out using any manner via a conduit 26 at the top of the digester 2. The conduit 26 joins the conduit 7 from the pretreatment vessel 1. Alternatively the conduit 26 can be eliminated. Spent cooking liquor is withdrawn after the digestion zone I and supplied through a conduit 11 to arrangement for flashing and evaporation (not shown). After withdrawal of spent cooking liquor, a second counter-current digestion zone II follows in which green liquor, such as NaOH, NaHS and $Na_2CO_3$, having a mid level sulfidity is introduced into the digester 2 via a conduit 12 for continued delignification of the chips in counterflow and at a temperature of about, I60 to about 180° C. At the lower part of the digester 2 is a zone III for buffering the chips with mainly sodium carbonate. For this purpose a conduit 14 is arranged between the conduit 13 and the digester 2 in order to make use of a part of the spent pretreatment liquid containing carbonate obtained. The delignified cellulosic fiber material is fed out via a conduit 15 for continued treatment in any conventional manner.

Arrangements are provided for the recovery of chemicals and energy from spent liquors and gases from the various steps of the process and for preparation of treatment liquids of these chemicals. These arrangements comprise a gasification reactor 3 for production of white liquor of high sulfidity and a gasification reactor 4 for the production of green liquor having a low sulfur content, as well as flashing and evaporation arrangements. The combustion gases produced in the gasification reactors 3 and 4 are conducted via conduits 18 and 22, respectively, to gas/liquid contact devices 19 and 21, respectively for liquid-gas, for example absorbers, in order to bring the combustion gases containing $H_2S$ into contact with the spent pretreatment liquor containing carbonate and/or with green liquor having a low sulfidity. Following evaporation to a higher dry solids content, the spent cooking liquor (black liquor) withdrawn from the digester 2 is distributed in a predetermined manner to the gasification reactors 3 and 4 via the conduits 16, 17.

The gas containing hydrogen sulfide is supplied from the pretreatment vessel 1 to the gas reactor 3 via conduit 7. The black liquor is gasified in the gasification reactor 3 under reducing conditions in the presence of $H_2S$ to form a melt of substantially $Na_2S$ and a combustion gas containing hydrogen sulfide. The gasification reactor 3 operates at a relatively low pressure, such as from about 1.5 to about 6 bar, preferably about 2 to about 4 bar, and the supply of $H_2S$ entails that an increased partial pressure for this gas is obtained so that the equilibrium reaction:

$$Na_2CO_3+H_2S \leftrightarrows Na_2S+CO_2+H_2O$$

is displaced to the right, thereby suppressing the formation of $Na_2CO_3$ and favoring the formation of $Na_2S$. The melt of $Na_2S$ is cooled and dissolved in a suitable aqueous liquid to form white liquor (also referred to as green liquor), NaOH and NaHS, having a high sulfidity. The white liquor produced is fed through the conduit 8 to the bottom of the pretreatment vessel 1. In the contact arrangement 19, sodium carbonate in the spent pretreatment liquid and green liquor having a low sulfidity react selectively with hydrogen sulfide and, to a lesser extent, with carbon dioxide to form a solution containing $NaHCO_3$ and NaHS. This solution of sodium bicarbonate and sodium hydrogen sulfide is supplied at a specific pressure and temperature to the pretreatment vessel 1 via the conduits 25 and 6 for pretreating the undigested cellulosic fiber material as described above. A pump (not shown) may be arranged in conduit 25 in order to achieve a high pressure if necessary.

The black liquor can be evaporated and thereafter gasified in the gasification reactor 4 under reducing conditions for the production of a combustion gas containing sulfur, which is cooled, and a melt of $Na_2CO_3$, $Na_2S$ and NaOH, which is dissolved and cooled in a liquid to form a green liquor comprising NaOH, NaHS and $Na_2CO_3$, which is fed out via a conduit 20, and a combustion gas containing hydrogen sulfide. The green liquor from the gasification reactor 4 has a lower content of NaHS than conventional green liquor since a major portion of the sulfur exists in the combustion gas as $H_2S$ due to the prevailing high operating pressure during the gasification. A first part of this green liquor is conducted to the digester 2 via a conduit 12, while a second part is conducted to the contact arrangements 19 and 21 via the conduit 13 and a conduit 23, and mixed with spent pretreatment liquid containing sodium carbonate withdrawn from the pretreatment vessel 1. In these contact arrangements 19 and 21, the gas containing $H_2S$ from the reactors 3 and 4 is brought into contact with the treatment liquids, combined or individually, so that solutions are formed containing sodium bicarbonate and sodium hydrogen sulfide. These solutions are fed out via the conduits 24 and 25 and combined to be conducted in the common conduit 6 under high pressure, typically 25 bar, and at high temperature, to the pretreatment vessel 1 in which a pressure reduction occurs causing expansion of the liquid and the evolution of carbon dioxide gas.

The temperature in the gasification reactors 3 and 4 is generally within the range of from about 500 to about 1600° C., preferably from about 700 to about 1300° C., and most preferably from about 800 to about 1000° C. In the gasification reactors 3 and 4, the black liquor is thermally decomposed under reducing conditions through the supply of pure oxygen gas or gas containing oxygen, in a quantity corresponding to from close to 0 up to 80%, preferably up to 60%, of the stochiometrically required amount of oxygen for complete oxidation of the substances formed at decomposition.

Anthraquinone may be added to the digester 2 if desired, in the zones where the $HS^-$ content of the digesting liquid is low. A conduit for the supply of anthraquinone may thus be connected to the conduit 12 for green liquor and/or to the conduit 14 for sodium carbonate. Anthraquinone may have a beneficial effect on the delignification reactions present in the digester.

Suitable equipment (not shown) is also provided in the conduit 7 for condensing the gas and forming a condensate which may be used for cooling and dissolving melt and cooling gas in the gasification reactor 3.

Suitable separation equipment can be constructed and arranged in one or both of the conduits 13 and 20 for separating elements foreign to the process, from the cellulosic fiber material.

The process steps of pretreatment, impregnation and digestion may be performed in one and the same vessel having separate stages, or in separate vessels. The pretreatment vessel may also be extended downwardly so that impregnation with the impregnation liquid occurs soon after the carbonate formed during the pretreatment has been withdrawn.

The manufacture of green liquor having a chemical make-up similar to white liquor such that the formed green liquor is referred to as white liquor, may be performed in two or more gasification reactors, for reasons of capacity or in order to obtain white liquors having different levels of sulfidity.

A part of the black liquor can be divided via conduit 17 to supply two or more gasification reactors for separate production of green liquor and pretreatment liquor containing sodium bicarbonate and sodium hydrogen sulfide. These two liquors can also be obtained in one and the same gasification reactor which is provided with two separate liquid baths, where the gas produced in the reactor is allowed to pass through one liquid bath to form sodium hydrogen bicarbonate and sodium hydrogen sulfide.

The distribution of the black liquor to the various gasification steps depends on the sulfidity of the liquor stock. In general, about 10 to about 60%, preferably about 20 to about 40%, of the black liquor is supplied to the first gasification step, i.e. to the gasification reactor 3, while the remaining is supplied to the gasification reactor 4.

It is advantageous to arrange a contact device for gas/liquid contact in the conduit 7 for $H_2S$ and $CO_2$,and to connect the conduit 16 for black liquor to this contact device, whereby the gas containing $H_2S$ and $CO_2$ is brought into contact with the black liquor so that $H_2S$ is absorbed selectively by the black liquor, while $CO_2$ can be withdrawn via a separate conduit. The black liquor thus enriched with sulfur is then conducted to the gasification reactor 3 for gasification in order to produce a melt comprising $Na_2S$. The contact device can be supplied with partially evaporated spent liquor from the digestion instead of black liquor, after which the spent liquor thus enriched with $H_2S$ is conducted to final evaporation in the evaporation plant to obtain black liquor which is then transferred to the gasification reactor 3.

Spent cooking liquor from the digester can be used as liquid for cooling the combustion gas and for cooling and dissolving the melt formed in the gasification reactor 3, particularly thin liquor, i.e. spent liquor which has not been evaporated and which has passed a first flash cyclone. A digesting liquid is thus obtained which comprises a mixture of white liquor and spent liquor. The condensate can at the same time advantageously be added at the outlet of the gasification reactor 3 to encounter the melt and the combustion gas. Such a condensate may thus be obtained in the condensation equipment in the conduit 7 and/or condensate free from alkali from the evaporation plant which preferably contains sulfur compounds.

Although it is a particular advantage of the method according to the invention that spent liquor from the digestion need not be added separately for impregnation of the cellulosic fiber material, such spent liquor may in certain cases be used.

The method according to the invention thus comprises a multi-stage process with total integration of the delignification and liquor recovery. Process chemicals for cellulosic fiber material pretreatment, impregnation and digestion can be produced continuously without the need of expensive equipment for causticizing. $CO_2$ can be easily stripped without having to use a complicated calcium cycle, namely together with the combustion gas and possibly with the contact device in the conduit 7. Necessary process chemicals can be produced with the desired compositions in each individual case, within an integrated gasification, liquor and gas treating system.

Naturally acid chips (cellulosic fiber material) can be treated at a temperature of about 70 to about 170° C. with expanded pretreatment liquid as the first process chemical containing sodium bicarbonate and sodium hydrogen sulfide. This expansion causing such a pressure decrease that $H_2S$ and $CO_2$ are released and that $H_2S$ and $HS^-$ are formed in situ. This pressure release continuous through the pretreatment tank under the influence of heat. No external $CO_2$ or other chemicals need be added to the pretreatment to assist in the reactions. $HS^-$ ions are formed during the pretreatment, which are preferred to $OH^-$ ions, after which the impregnation and digestion steps are commenced with a digesting liquid having a high sulfidity.

In most cases it is desirable to be able to distribute the sulfur in the process between high sulfidity white liquor and low sulfidity green liquor to the digester according to the current need for delignification and the sulfidity of the liquor material. This desire can be fulfilled with a preferred embodiment of the invention in which a first part of the green liquor having low sulfidity is brought into contact with a sulfurous compound, after which the green liquor thus enriched with sulfur is supplied to the digestion process to be present in the second digestion zone and/or in an additional digestion zone downstream of the second digestion zone. One method is for the $H_2S$ to be absorbed selectively in the low sulfidity green liquor before being conducted to the digester. Another method is to lead a flow of gas containing $H_2S$ to a Claus apparatus for producing liquid sulfur in accordance with the following reactions:

$$H_2S+3/2O_2 \rightarrow SO_2+H_2$$

$$2H_2S+SO_2 \rightarrow 3S_{(1)}+2H_2O$$

Sulfurous residue gas is suitably conducted to the gasification step that produces white liquor having a high sulfidity. The flow of gas containing $H_2S$ may be obtained from the pretreatment vessel and/or from gas scrubbing with a suitable absorption chemical for selective and regenerative absorption of $H_2S$, which is desorbed and conducted wholly or partially to the Claus furnace. These sources of $H_2S$ can also be utilized in the first embodiment mentioned above. $S_{(1)}$ can be extracted from the Claus furnace and added to the low sulfidity green liquor, preferably together with a flow of $Na_2S$ obtained from said gasification for the production of high sulfidity white liquor, to produce polysulfides according to the reactions:

$$Na_2S+S \rightarrow Na_2S_2$$

$$Na_2S_2+S \rightarrow Na_2S_3, \text{ and so on.}$$

For example, $S_{(1)}$ can be directly added to the liquor mixture containing $Na_2S$, at a temperature of about I60 to about 200° C. Polysulfide can also be produced by absorbing $H_2S$, such as from one of the $H_2S$ sources, in $S_{(1)}$. In this case the addition of high sulfidity liquor may be omitted. While not preferred, some of the green liquor poor in sulfide and/or the solution of $Na_2CO_3$ may be causticized if so desired.

The integration of the process steps according to the invention entails valuable combined effects. Sulfur resources can be redistributed and utilized more efficiently according to the current demand of the pulping process. The sulfur is available in active form, which offers an increase of about 7 to about I0% over sulfur obtained through the soda recovery unit method. A small quantity of NaOH, about 5% by weight of the melt, is obtained during gasification. In particular, green liquor of low sulfidity contains a relatively small proportion of NaOH. The neutralization of the wood acid and buffering is achieved substantially by means of dissociated $Na_2CO_3$ solutions of high temperature, without consuming active digestion chemicals.

If desired the digestion liquor may contain various additives such as an organic additive, e.g. a suitable alcohol.

In order to compensate for unavoidable losses of process chemicals, suitable make-up chemicals such as $Na_2SO4$ may be added and/or sulfate soap is returned. Sulfate soap is a sulfur rich bi-product which can be separated from the black liquor during evaporation. The sulfate soap can be used as a source of sulfur to increase the sulfidity of a liquor.

The expression white liquor having high sulfidity" in this description and in the following claims also includes a polysulfide-based digestion liquor.

The pressures stated above and in the appended claims relate to absolute pressure.

Pretreatment According to Second Embodiment

The sulfur content of the undigested cellulosic fiber material can be enhanced by utilizing a pretreatment liquid which has been formed from a spent liquor having a high sulfidity. The term "high sulfidity" is understood herein to mean having a sulfidity higher than the usual and conventional sulfidity of the selected spent liquor utilized in pulp production. For example, black liquor utilized in pulp production usually has a sulfidity in the range of from about 30% to about 40%. Therefore, the use of the term "high sulfidity" in reference to a black liquor which has been formed in a process according to the present invention means having a sulfidity greater than about 40%, preferably from about 50% to about 90%, and most preferably from about 70% to about 90%.

The high sulfidity spent liquor is preferably a high sulfidity spent black liquor from a digester which has been operated under enhanced sulfidity. A suitable example of such black liquor, is the black liquor produced by operating the three zone, concurrent/counter current digester as described in first embodiment above. By utilizing a high sulfidity spent black liquor, the sulfur can advantageously be continuously recycled from pretreatment step to digestion step to pretreatment step, and so on. In this manner, the amount of outside sulfur required to enhance the sulfidity during digestion to the desired level can be significantly decreased.

The pretreatment liquid should be brought into contact with the undigested pulp under conditions such that hydrogen sulfide compounds present in the pretreatment liquid are absorbed or dispersed into the undigested cellulosic fiber material to produce an undigested cellulosic fiber material having an enhanced concentration of hydrogen sulfide. Thus, the pretreatment liquid should contain hydrogen sulfide or be capable of forming hydrogen sulfide under the prevailing conditions in the pretreatment vessel.

If the sulfidity of the spent liquor is not at the desired level for use as a pretreatment liquid, the sulfidity of the spent liquor can be enhanced. For example, the sulfidity of the pretreatment liquid can be enhanced by contacting the pretreatment liquid with a gas containing $H_2S$. Any of the methods for enhancing the sulfidity described in the first embodiment can be utilized, such as combustion gas from a gasification reactor which contains $H_2S$.

The sulfidity of the pretreatment liquid can also be enhanced by adding a high sulfidity liquid, such as high sulfidity white liquor. Alternatively, sulfur containing compounds can be directed added to the pretreatment liquid to enhance the sulfidity.

The pretreatment liquid should be added to the cellulosic fiber material in an amount sufficient to provide the desired level of sulfur in the cellulosic fiber material. Preferably, the pretreatment liquid is added in an amount sufficient to provide an increase in the sulfur content of the undigested cellulosic fiber material that provides the desired Kappa number in the digested cellulosic fiber material. The kappa number is a well known term in the pulping art field. In general, the lower the desired kappa number of the digested cellulosic fiber material, the greater the quantity of effective alkali that should be added to the undigested cellulosic fiber material. Conversely, the higher the desired kappa number of the digested cellulosic fiber material, the less the quantity of effective that should be added to the undigested cellulosic fiber material. A high content of sulfur means a high content of effective alkali by driving the following equilibrium reaction to the right.

$$Na_2S \leftrightharpoons NaOH+NaHS$$

Based on the disclosure provided herein, one skilled in the art will easily be able to determine the amount of pretreatment liquid necessary to provide the desired Kappa number for the digested cellulosic fiber material.

The pretreatment reaction should be conducted for time period sufficient to increase the level of $HS^-$ ions in the undigested cellulosic material to the desired level. For example, on a commercial scale pulp mill, the complete adsorption of $HS^-$ ions into the undigested cellulosic fiber material usually requires at least about 30 minutes, more preferably at least about 50 minutes retention time in a pretreatment vessel.

The process conditions, such as pressure and temperature, can be varied or kept constant as the pulp travels through the pretreatment reaction vessel, as desired. For example, if a vertical pretreatment vessel is utilized, the pressure can increase as the undigested cellulosic fiber material travels towards the bottom of the pretreatment vessel.

Figure 2:
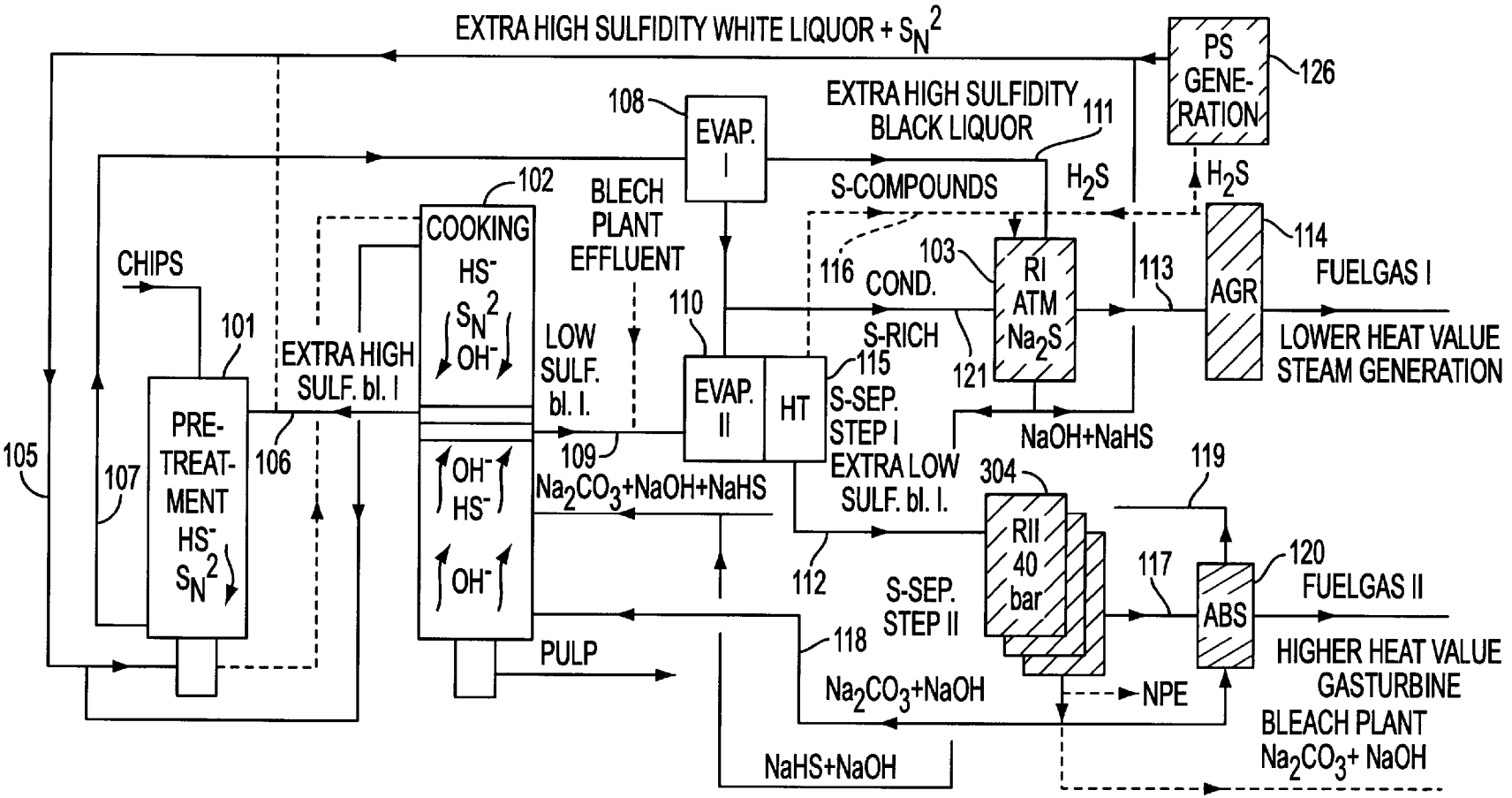
FIG. 2 illustrates a schematic diagram of a second embodiment according to the present invention.

A preferred embodiment according to second embodiment of the invention will now be described in detail with reference to FIG. 2. FIG. 2 schematically illustrates a flow chart of a process line for the manufacture of paper pulp according to the second embodiment of the present invention. In the system according to FIG. 2, the undigested cellulosic fiber material is pretreated with black liquor having high sulfidity in the pretreatment vessel 101. A part of the spent pretreatment liquid is withdrawn from the pretreatment vessel and is transferred via conduit 107 to the evaporation stage shown at 108. After the pretreatment stage, the cellulosic fiber material is conveyed to the digester 102, which includes an upper concurrent digestion zone I and two lower counter current digestion zones II and III, as shown in FIG. 3. White liquor having a sulfidity of at least about 40%, preferably at least 45%, even more preferably at least about 50%, and most preferably at least about 70%, is combined with the cellulosic fiber material via conduit 105 prior the entrance into the concurrent zone I to constitute a part of a first digesting liquor. A high sulfidity black liquor (spent liquor) is withdrawn from the concurrent zone I and is transferred via conduit 106 to the pretreatment vessel 101. The concurrent digestion zone I is followed by a counter-current digestion zone II, which is supplied with a second digesting liquor via conduit 119, comprises alkali metal carbonate, and also alkali metal hydroxide and alkali metal hydrogen sulfide. The second digesting liquor usually has a sulfidity of about 10 to about 40%, preferably about 20 to about 40%, and most preferably about 25 to about 35%. The digestion zone II is followed by a third zone III, which is counter-current and is supplied with a third digesting liquor, via conduit 118. The third digesting liquor comprises alkali metal carbonate and alkali metal hydroxide, and is substantially free of alkali metal hydrogen sulfide. The third digesting liquor usually has a sulfidity of about 10% or less, preferably about 7% or less, and more preferably about 3% or less. The counter-current digestion zones II and III can be operated at a temperature of at least about 160° C., preferably about 160 to about 180° C., and even more preferably about 165 to about 170° C. Solutions containing $Na_2CO_3$, such as the second and third digesting liquors, have an equilibrium reaction such that greater quantities of $OH^-$ ions are present at high temperatures. Thus, a relatively high temperature in the counter-current zone II is favorable, to thereby provide an increased concentration of $OH^-$ ions. A second spent cooking liquor is withdrawn from the counter-current zone II and is transferred via conduit 109 to the evaporation stage 110.

The first spent cooking liquor, withdrawn from the digester via conduit 107, has a high sulfidity. This spent cooking liquor is condensed by the evaporators 108, and then transferred via conduit 111 to a first gasification reactor 103, which operates in the substantially same way as gasification reactor 3 in FIG. 1. Gasification reactor 103 thus operates at a relatively low pressure and with an equilibrium which is displaced towards a high content of $Na_2S$ in the produced melt and consequently a high content of NaHS in the quench liquor formed from the melt. The quench liquor is a high sulfidity white liquor which is transferred via conduit 105 to the concurrent zone 1 in the digester 102. If desired, the concentration of hydroxyl ions, $OH^-$, in the white liquor present in conduit 105 can be reduced and the sulfidity increased by selectively adding $H_2S$ to the white liquor to form NaHS according to the following equation:

$$NaOH+H_2S \rightarrow NaHS+H_2O$$

The sulfidity of the white liquor in the conduit 105 can also be increased by adding polysufide, as shown at 126.

Sulfur containing compounds, especially $H_2S$, are transferred via conduit 116 to the reactor 103 in order to force the following equilibrium to be displaced to the right to form more $Na_2S$:

$$Na_2CO_3+H_2S \leftrightharpoons Na_2S+CO_2+H_2O$$

These sulfur containing compounds can have their origin in any desired source. The sulfur containing compounds can, for example, be separated from the combustion gas 113 from the first reactor 103 (or from the combustion gas from a second gasification reactor), by an acid gas removal system 114, where the gas is passed though a gas scrubber with an external absorption chemical, or they can be separated from the second spent liquor 109 by heat treatment 115. Furthermore, sulfur rich condensates 121 can be transferred to the reactor 103.

The second spent liquor 109 of low sulfidity, can, as has been indicated, be heat treated 115 in any known manner, in order to separate out sulfur containing compounds. The spent liquor is thereafter transferred 112 to a second gasification reactor 104, which operates at a relatively high pressure, for example, at least about 20 bar, preferably at least about 30 bar, and even more preferably at least about 40 bar. The equilibrium in the second reactor is thus displaced so that a major part of the sulfur containing compounds in the spent liquor ends up in the combustion gas 117. The liquor 118 which is produced from the melt from reactor 104 comprises alkali metal carbonate, and also alkali metal hydroxide and alkali hydrogen sulfide. This liquor is used as the third digesting liquor in the counter current digestion zone III. A part of the liquor 118 from reactor 104 is supplied to a gas/liquid contacter 120 along with the combustion gas 117 from the same reactor in order to add $H_2S$ to the liquor, which then is transferred 119 to the counter current digestion zone II. Optionally, NaOH, such as from an optional causticizing plant, can be added to the liquor 119 before the liquor is added to the digester 102.

As an alternative to, or possibly in combination with the pretreatment with black liquor of high sulfidity, the undigested cellulosic fiber material may be pretreated with alkali metal carbonate, preferably $Na_2CO_3$ from the second gasification reactor 104.

It is advantageous to use polysulfides in the cooking stages, especially in the concurrent zone I which operates at a high sulfidity level, since $HS^-$ ions stabilize polysulfides against decomposition. The decomposition of polysulfides can be a problem at high temperatures. For instance, at a cooking temperature of about 160 to about 170° C., about 25% of existing polysulfides are usually thermally decomposed.

The separately withdrawn spent liquors may be wholly, or preferably partially, combined to create tailor made spent liquors from the different gasification reactors, which may be more than two. In this way the system creates an unique possibility to variably control the composition of the liquors that are produced in the reactors.

While FIG. 2 shows two evaporators, 108 and 110, for condensing the black liquor, it is possible to utilize one evaporator or more than two evaporators. FIG. 2 also shows two gasification reactors, which is the preferred number. However, it is possible to practice the invention utilizing more than two gasification reactors, or one gasification reactor. The amount of black liquor sent to each of the gasification reactors will depend upon the amount of sulfur present in the pulp production plant. In general, the greater the quantity of sulfur, the greater amount of black liquor that can be supplied to the first gasification reactor 103 in comparison to the second gasification reactor 104. For example, the amount of black liquor supplied to the first gasification reactor is usually about ⅓ of the total amount of black liquor and the amount of black liquor supplied to the second gasification reactor is about ⅔ of the total amount of black liquor.

Many of the features described above, in connection with the embodiment shown in FIG. 1, are applicable in the embodiment shown in FIG. 2. For example, this is true for the parts that describe absorption of $H_2S$ in any suitable liquor, especially in a spent liquor before it is gasified or used as a pretreatment liquor. Also, the described equipment for gas/liquid contact is applicable, as is the described equipment for gasification, the method of producing polysulfide, the method of buffering the counter current digestion zone, the possibility to add anthraquinone, and the possibility to causticize a part of the low sulfidity green liquor to produce NaOH which can be used in a bleach department. Based on the disclosure provided herein, one of ordinary skilled in the art will easily be able to determine the parts that are applicable in the different embodiments. In this manner, pulp production plants based on the present invention provide a very high degree of versatility.

Combination of First Embodiment and Second Embodiment

The pulp production plant can be designed such that it will be easy to switch the pretreatment step in the pretreatment vessel between the first and second embodiments as desired. In this manner, the pretreatment stage which is easier to conduct, based on the spent liquors and/or combustion gasses formed during pulp production, can be utilized.

If desired, the undigested cellulosic fiber material can be subjected to two or more pretreatment stages, in which one pretreatment stage is as described in the first embodiment and another pretreatment stage is as described in the second embodiment.

In some instances, one pretreatment stage can be used which utilizes a combination of the first and second embodiments. However, if the spent liquor to be used as the pretreatment liquor in the second embodiment contains hydroxyl ions, $OH^-$, it should not be combined with a pretreatment liquid according to the first embodiment because an undesirable reaction between the hydroxyl ions and the alkali metal bicarbonate may occur.

While the invention has been described in detail and with reference to specific embodiments thereof, it will be apparent to those of ordinary skill in the art that various changes and modifications can be made to the claimed invention without departing from the spirit and scope thereof.

I claim:

1. A process for making a sulfur enhanced, undigested cellulosic fiber material comprising the step of:

contacting an undigested cellulosic fiber material with a pretreatment liquid formulated from a mixture comprising alkali metal bicarbonate and alkali metal hydrogen sulfide as reaction components which are dissolved or disbursed in an aqueous liquid, under conditions that:

(1) the reaction components react to form $H_2S$, $CO_2$ and alkali metal carbonate in situ;

(2) $HS^-$ ions are formed by disassociation of $H_2S$ and/or by disassociation of alkali metal hydrogen sulfide; and (3) at least a portion of the $H_2S$ and/or HS ions is absorbed or diffused into the undigested cellulosic fiber material to enhance the sulfur content of the undigested cellulosic fiber material, to form a sulfur enhanced, undigested cellulosic fiber material, wherein said pretreatment liquid is substantially free of alkali metal hydroxide.

2. A process according to claim 1, wherein a spent pretreatment liquor comprising said alkali metal carbonate is formed and said process further comprises the step of separating said liquid comprising alkali metal carbonate from said sulfur enhanced cellulosic fiber material.

3. A process according to claim 2, further comprising the step of regenerating said pretreatment liquid from said spent pretreatment liquor by contacting said spent pretreatment liquor with a gas comprising $H_2S$ under conditions whereby said alkali metal carbonate reacts with said $H_2S$ to form alkali metal bicarbonate and alkali metal hydrogen sulfide to form a regenerated pretreatment liquid.

4. A process according to claim 3, wherein at least a portion of said regenerated pretreatment liquid is used as said pretreatment liquid.

5. A process for making pulp comprising the steps of:

contacting an undigested cellulosic fiber material with a pretreatment liquid formulated from a mixture comprising alkali metal bicarbonate and alkali metal hydrogen sulfide as reaction components which are dissolved or disbursed in an aqueous liquid, under conditions that:

(1) the reaction components react to form $H_2S$, $CO_2$ and alkali metal carbonate in situ;

(2) $HS^-$ ions are formed by disassociation of $H_2S$ and/or by disassociation of alkali metal hydrogen sulfide; and (3) at least a portion of the $H_2S$ and/or $HS^-$ ions is absorbed or diffused into the undigested cellulosic fiber material to enhance the sulfur content of the undigested cellulosic fiber material, to form a sulfur enhanced, undigested cellulosic fiber material, wherein said pretreatment liquid is substantially free of alkali metal hydroxide; and digesting said sulfur enhanced, undigested cellulosic fiber material in a digester to form a pulp.

6. A process according to claim 5, wherein a spent pretreatment liquor comprising said alkali metal carbonate is formed and said process further comprises the step of separating said liquid comprising alkali metal carbonate from said sulfur enhanced cellulosic fiber material.

7. A process according to claim 6, further comprising the step of regenerating said pretreatment liquid from said spent pretreatment liquor by contacting said spent pretreatment liquor with a gas comprising $H_2S$ under conditions whereby said alkali metal carbonate reacts with said $H_2S$ to form alkali metal bicarbonate and alkali metal hydrogen sulfide to form a regenerated pretreatment liquid.

8. A process according to claim 7, wherein at least a portion of said regenerated pretreatment liquid is used as said pretreatment liquid.

9. A process according to claim 5, further comprising the step of using a multi stage digester, supplying a high sulfidity liquor to a first stage of said digester, a mid level sulfidity liquor to a second stage of said digester, and a low sulfidity liquor to a third stage of said digester, wherein said digester is constructed and arranged such that said sulfur enhanced, undigested cellulosic fiber material passes through said first stage, followed by said second stage, and then said third stage.

10. A process according to claim 9, wherein said high sulfidity liquor comprises a white liquor formed from quenching a melt from a first gasification reactor.

11. A process according to claim 9, further comprising the step of gasifying a spent liquor from said digesting step in a second gasification reactor to form a second combustion gas containing at least one sulfur compound and a second liquor.

12. A process according to claim 11, wherein at least a portion of said second liquor is supplied to said digester as said low sulfidity liquor.

13. A process according to claim 9, further comprising the step of gasifying a spent liquor from said digesting step in a first gasification reactor to form a first combustion gas containing at least one sulfur compound and a first liquor.

14. A process according to claim 13, wherein at least a portion of said first liquor is supplied to said digester as said high sulfidity liquor.

* * * * *